US005879081A

United States Patent [19]

Chordia

[11] Patent Number: 5,879,081

[45] Date of Patent: Mar. 9, 1999

[54] MIXING APPARATUS HAVING SELF-SEALING SPRING-LOADED SEALS

[76] Inventor: Lalit M. Chordia, 457 Dover Dr., Pittsburgh, Pa. 15238

[21] Appl. No.: 906,003

[22] Filed: Aug. 4, 1997

Related U.S. Application Data

[63] Continuation of Ser. No. 707,053, Sep. 3, 1996, abandoned, which is a continuation of Ser. No. 370,151, Jan. 9, 1995, abandoned.

[51] Int. Cl.[6] ..... B01F 7/20; B01F 13/06

[52] U.S. Cl. ..... 366/249; 366/347

[58] Field of Search ..... 366/130, 197, 366/199, 204, 205, 242–260, 347

[56] References Cited

U.S. PATENT DOCUMENTS

| | | | |
|---|---|---|---|
| 2,387,024 | 10/1945 | Hishon et al. | 366/251 X |
| 2,661,938 | 12/1953 | Kuentzel | 366/242 X |
| 2,901,295 | 8/1959 | Becker | 366/249 X |
| 2,940,738 | 6/1960 | Posener et al. | 366/205 |
| 3,612,126 | 10/1971 | Emmons et al. | 366/205 X |
| 4,721,390 | 1/1988 | Lidgren | 366/139 |
| 4,758,096 | 7/1988 | Gunnarsson | 366/197 X |
| 4,973,168 | 11/1990 | Chan | 366/130 X |
| 5,108,715 | 4/1992 | Jekat et al. | 366/251 X |
| 5,145,250 | 9/1992 | Planck et al. | 366/197 C X |

*Primary Examiner*—Charles E. Cooley
*Attorney, Agent, or Firm*—Ansel M. Schwartz

[57] ABSTRACT

The mixing apparatus comprises a pressure vessel having a chamber and a first opening that communicates with the chamber. The mixing apparatus also comprises a first cap which fits over the first opening to engage the vessel and close the first opening. Additionally, the mixing apparatus comprises a stirrer having a shaft. The shaft extends through the first cap into the chamber. There is a motor connected to the shaft to turn the shaft. The motor is disposed adjacent to the vessel and external to the chamber. Moreover, there is a first self-sealing spring-loaded seal disposed between and preferably in contact with the first cap and the vessel to seal the first cap with the vessel as pressure increases in the vessel. The mixing apparatus comprises a shaft self-sealing spring-loaded seal which seals the shaft to the first cap as pressure increases in the vessel. The shaft is rotatable in the shaft self-sealing spring-loaded seal.

10 Claims, 5 Drawing Sheets

MIXING APPARATUS HAVING SELF-SEALING SPRING-LOADED SEALS

This application is a continuation of application Ser. No. 08/707,053 files on Sep. 3, 1996 abandoned, which is a continuation of application Ser. No. 08/370,151 filed on Jan. 9, 1995 now abandoned.

FIELD OF THE INVENTION

The present invention relates generally to sealing a rotating shaft in high pressure vessels and more particularly to seal a mechanical stirrer in a high pressure vessel used for supercritical fluids. Other applications for this technology are in pharmaceutical, food and chemical industries.

BACKGROUND OF THE INVENTION

Current available sealing methodologies for the mechanical stirring of vessels under high pressure is cumbersome, unreliable and does not have long life. This has always been a problem in the pharmaceutical and chemical industry and a number of users have used magnetic stirrer systems to eliminate this problem. However, magnetic stirrer systems are not always convenient and cannot be used in many instances either due to incompatibility to vessel material or due to inaccessibility.

Traditional design that does not use magnetic stirrers uses o-rings and packings as seal mechanisms for the stirrers. These types sealing mechanisms require additional forces to be exerted on them to provide the seal. This force increases with increasing operating pressure. The high force on a rotating shaft leads to a tenuous seal life. To try alleviate this problem, designers have developed multiple seal designs. However, this benefits comes with a major disadvantage: seal replacement has become a very tedious job. This problem is obvious from the lack of any competitively priced mechanical stirrers for pressures greater than 1500 psi and especially for pressures greater than 5 or 10,000 psi.

Replacing the o-rings or packings with a special energized seals such as the spring loaded seals that are similar to the ones used in HPLC pumps, provide an effective sealing method requiring very minimal force. It is practically "self-sealing". The seal consists of a polymeric body with a metal spring or a o-ring in the middle. The spring pushes the two lips of the seal outside. One side of the seal touches the body of the vessel and the other side of the seal touches the cap. When the pressure inside the vessel increases, it acts against the seal and pushes the lips even further towards the wall. This type of a seal requires very little force to maintain a seal.

The spring loaded seal is more forgiving on the stirrer shaft than the other seals. This allows the design to incorporate a little misalignment on the stirrer shaft and thus a more robust sealing mechanism. A smoother finish on the stirrer shaft (especially where the spring loaded seal is) also increases the life of the seal. This can be accomplished in many ways: a polished shaft, a polished ceramic shaft, or a ceramic coated shaft.

The stirrer shaft can be rotated through a number of ways. Connecting to an electric motor directly would be the simplest. By controlling either the voltage or the current or both, the stirrer speed can be controlled. The electric motor can be replaced with an air motor. This would be especially important in explosion proof environments.

A high pressure stirring system can increase the rate of extraction and rate of reactions under various conditions.

For instance, in supercritical or subcritical fluid extraction, stirring has shown to have improved reaction rates by numerous personnel in the area of natural product extraction, precision cleaning using supercritical carbon dioxide and reactions under supercritical conditions.

SUMMARY OF THE INVENTION

The mixing apparatus comprises a pressure vessel having a chamber and a first opening that communicates with the chamber. The mixing apparatus also comprises a first cap which fits over the first opening to engage the vessel and close the first opening. Additionally, the mixing apparatus comprises a stirrer having a shaft. The shaft extends through the first cap into the chamber. There is a motor connected to the shaft to turn the shaft. The motor is disposed adjacent to the vessel and external to the chamber. Moreover, there is a first self-sealing seal disposed between and preferably in contact with the first cap and the vessel to seal the first cap with the vessel as pressure increases in the vessel. The mixing apparatus comprises a shaft self-sealing seal means which seals the shaft to the first cap as pressure increases in the vessel. The shaft is rotatable in the shaft self-sealing seal means.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
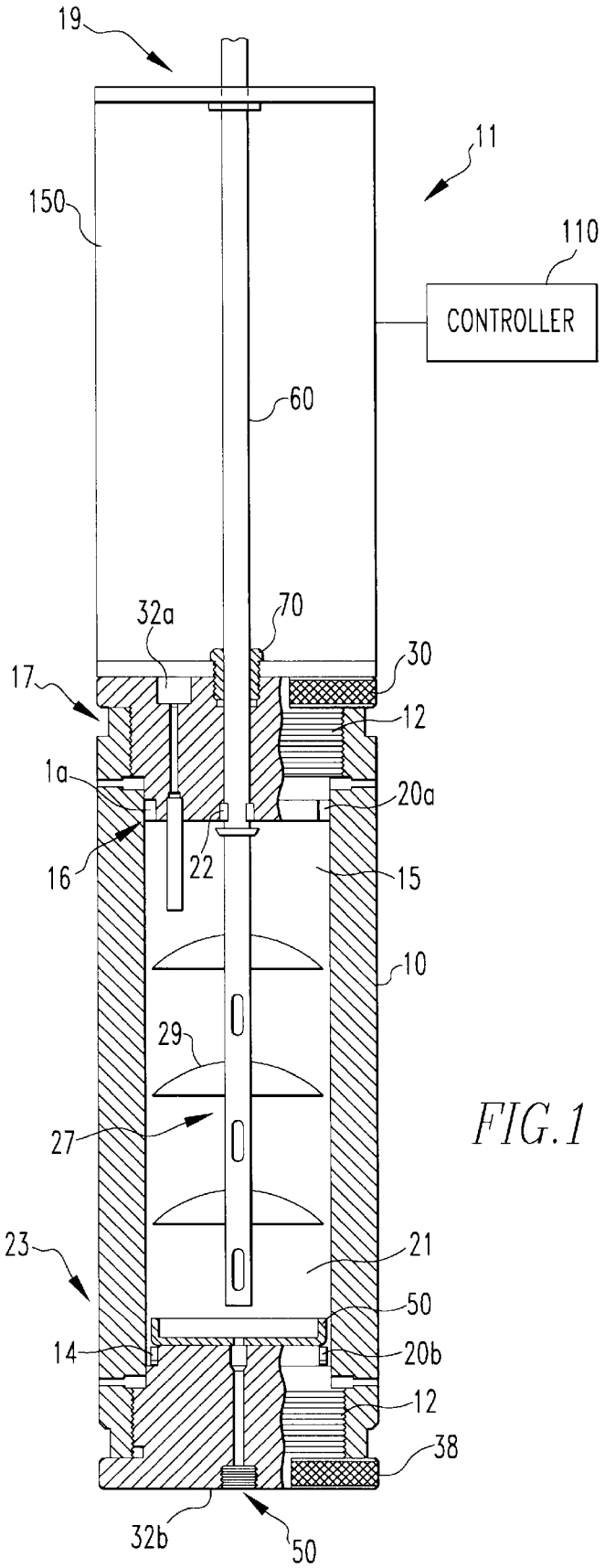
FIG. 1 is a schematic representation of a mixing apparatus of the present invention.

Referring now to the drawings wherein like reference numerals refer to similar or identical parts throughout the several views, and more specifically to FIG. 1 thereof, there is shown a mixing apparatus 11. The mixing apparatus 11 comprises a pressure vessel 10 having a chamber 15 and a first opening 17 that communicates with the chamber 15. The mixing apparatus 11 also comprises a first cap 30 which fits over the first opening 17 to engage the vessel 10 and close the first opening 17. Additionally, the mixing apparatus 11 comprises a stirrer 19 having a shaft 60. The shaft 60 extends through the first cap 30 into the chamber 15. There is a motor 150 connected to the shaft 60 to turn the shaft 60. The motor 150 is disposed adjacent to the vessel 10 and external to the chamber 15. Moreover, there is a first self-sealing seal means 20*a*, which includes a first self-sealing seal disposed between and preferably in contact with the first cap 30 and the vessel 10 to seal the first cap 30 with the vessel 10 as pressure increases in the vessel 10. The mixing apparatus 11 comprises a shaft self-sealing seal means, which includes a shaft self-sealing seal 22 which seals the shaft 60 to the first cap 30 as pressure increases in the vessel 10. The shaft 60 is rotatable in the shaft 60 self-sealing seal 22. Preferably, the first cap 30 has a first port 32*a* through which material 21 is introduced into the chamber 15.

The vessel 10 preferably has a second opening 23 in communication with the chamber 15. The apparatus 11 can then include a second cap 38 which fits over the second opening 23 to engage the vessel 10 and close the second opening 23. Additionally, there is then a second self-sealing seal 20*b* disposed between and in contact with the second cap 38 and the vessel 10 as pressure increases in the vessel 10. Preferably, the second cap 38 has a second port 32*b* through which material 21 is introduced into the chamber 15. Preferably, the vessel 10 is threaded about the first and second openings, and the first and second caps are threaded to threadingly engage with the vessel 10 at the respective openings.

The apparatus 11 can also include a seal retainer 40 which holds the shaft self-sealing seal 22 in place. There can be an insert 70 disposed in the first cap 30 through which the shaft. 60 extends. The insert 70 maintains and aligns the shaft 60 in the chamber 15. Preferably, the shaft 60 has a first portion 27 disposed in the chamber 15. There can be protrusions 29 extending from the first portion 27 of the shaft 60. The shaft can be made out of a material having a surface smoothness between 0.001 to 1 microns, a hardness of 4–20 mohs, a coefficient of linear thermal expansion of $0–20\times10^{-6}/°C$. and a thermal conductivity of 10–100W/M-K, such as sapphire or alumina oxide ceramic. The shaft 60 is preferably made out of sapphire, although it could be zirconium oxide, aluminum oxide, etc. or ceramic or diamond coated. The smooth surface of the shaft 60 can be accomplished by a) polished surface, b) by single or multiple coatings of the shaft surface to provide an extremely smooth material leading to extremely low coefficient of friction. The vessel is able to withstand pressures up to 12,000 psi in the chamber 15. The apparatus 11 can be used for extraction or reaction of solids, liquids or fluids under supercritical or subcritical conditions. The fluids can be, for example, carbon dioxide, water, hydrocarbon solvents, ammonia and other solvents.

The first self-sealing seal means has an inner lip 128 and an outer lip 126. The inner lip 128 contacts the cap 30. The outer lip 126 contacts the vessel 10. The inner and outer lips are spread apart from each other and against the first cap 30 and vessel 10, respectively, as pressure increases in the vessel 10, and a first spring 105 disposed between the inner and outer lips in outer seal groove 121 to bias the lips against the cap 30 and vessel 10, respectively.

The embodiment consists of a vessel 10, as shown in FIG. 1, threaded at each end 12. At each end of the vessel 10, there are two threaded caps 30 and 38, a self sealing seal 20*a*, 20*b* for each cap which seals the vessel to the cap, a shaft self sealing seal 22 which seals the shaft 60 to the cap, a seal retainer 40 and frit that acts as a flow distributor 50 and also retains solid material inside.

The caps 30 and 38, have a port 32*a*, 32*b* for the fluid to flow in and out. The cap 30 has a place where the seal 22 touches the surface of cap 30. This cap surface 34 and the shaft surface 62 have to be extremely smooth and hard. The hard smooth surface leads to low friction and increase the seal life.

The caps 30, 38 along with the seals 20*a*, 20*b* and the frit holder 50 are screwed into the vessel 10 at each of the ends 12. As the cap 38 is screwed in, the seal 20*b*, comes into contact the vessel at seal surface 14. The seal surface 14 has to be very smooth and hard to decrease friction and increase the life of the seal. Once the seal 20*b* has come into full contact with seal surface 14, any fluid 50, can be introduced through the ports 32*a*, 32*b*. Similarly, cap 30 along with the seal 20, shaft 60, shaft seal 22, insert 70, and seal retainer 40 is screwed into the vessel 10.

Figure 3:
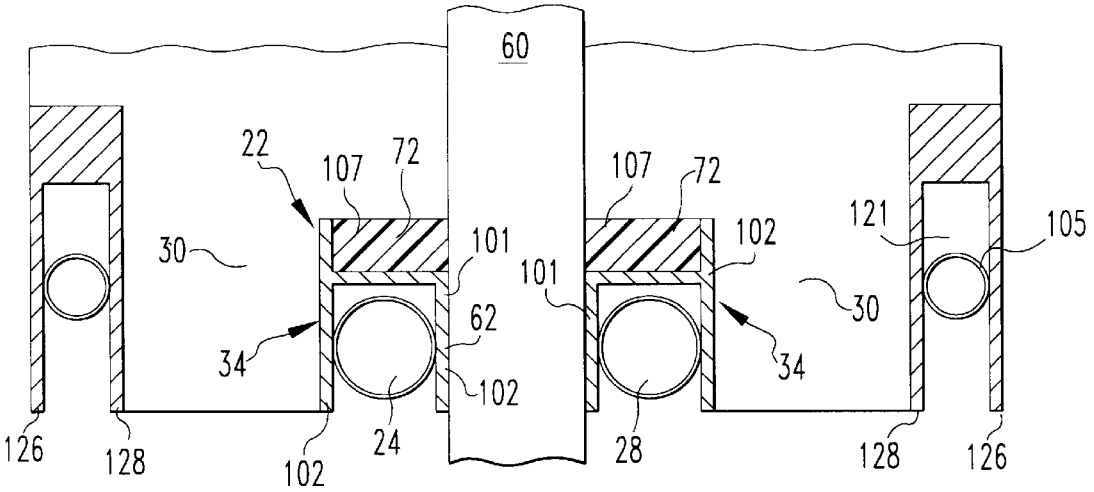
FIG. 3 is a schematic representation of an upper portion of the mixing apparatus of the present invention.
Figure 2:
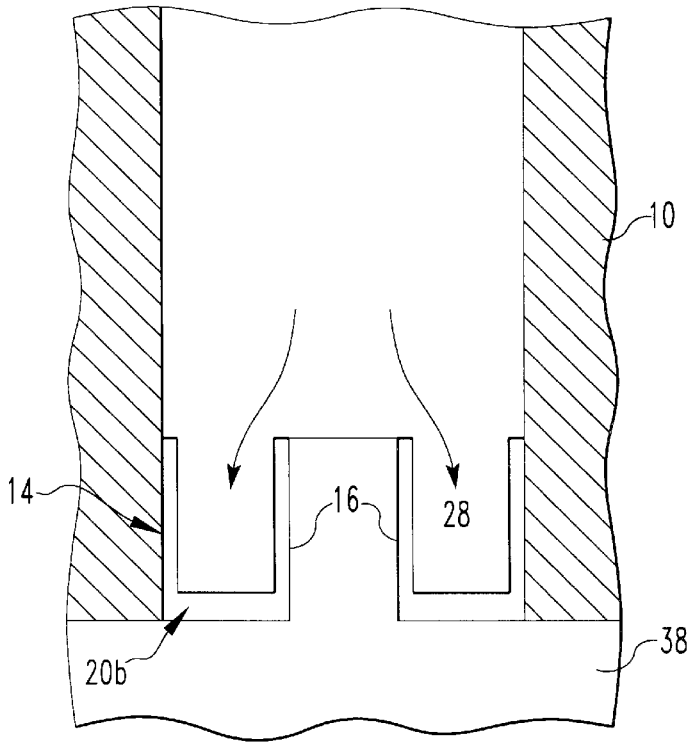
FIG. 2 is a schematic representation of a lower portion of the mixing apparatus of the present invention.

As the fluid is introduced into the vessel through the port 32*a*, 32*b* the pressure increases. The fluid flows into the seal groove 24 and 28 and provides the force for the shaft seal 22 to seal against the seal surfaces 62 and 34 and the seal 20*b* against the seal surfaces 14 and 16, as shown in FIGS. 2 and 3. Rotating the shaft 60 will not allow any fluid to leak to the atmosphere.

The shaft seal 22 can be supported by a back up seal 72 and an insert 70 to maintain the alignment, as shown in FIG. 3. This provides for greater reliability and increased life of shaft seal 22. The force on the shaft 60 is taken by a shaft coupler block 108 which is screwed into the cap 30 by two screws 112. The thrust washer 104 rests against a clamp 102 and rotates against bracket surface 106. The shaft 60 can be connected directly to a motor 150 through a coupler 122. The motor speed can be controlled through a controller 110.

One or both the ports 32*a*, 32*b* in caps 30 and 38 can be replaced with ports in the vessel 10. The shaft 60 can be coated with ceramic to make sure the shaft surface 62 is extremely smooth and low friction. The shaft 60 can also be made of sapphire or other ceramics to provide for an extremely smooth surface and low friction surface.

Figure 4:
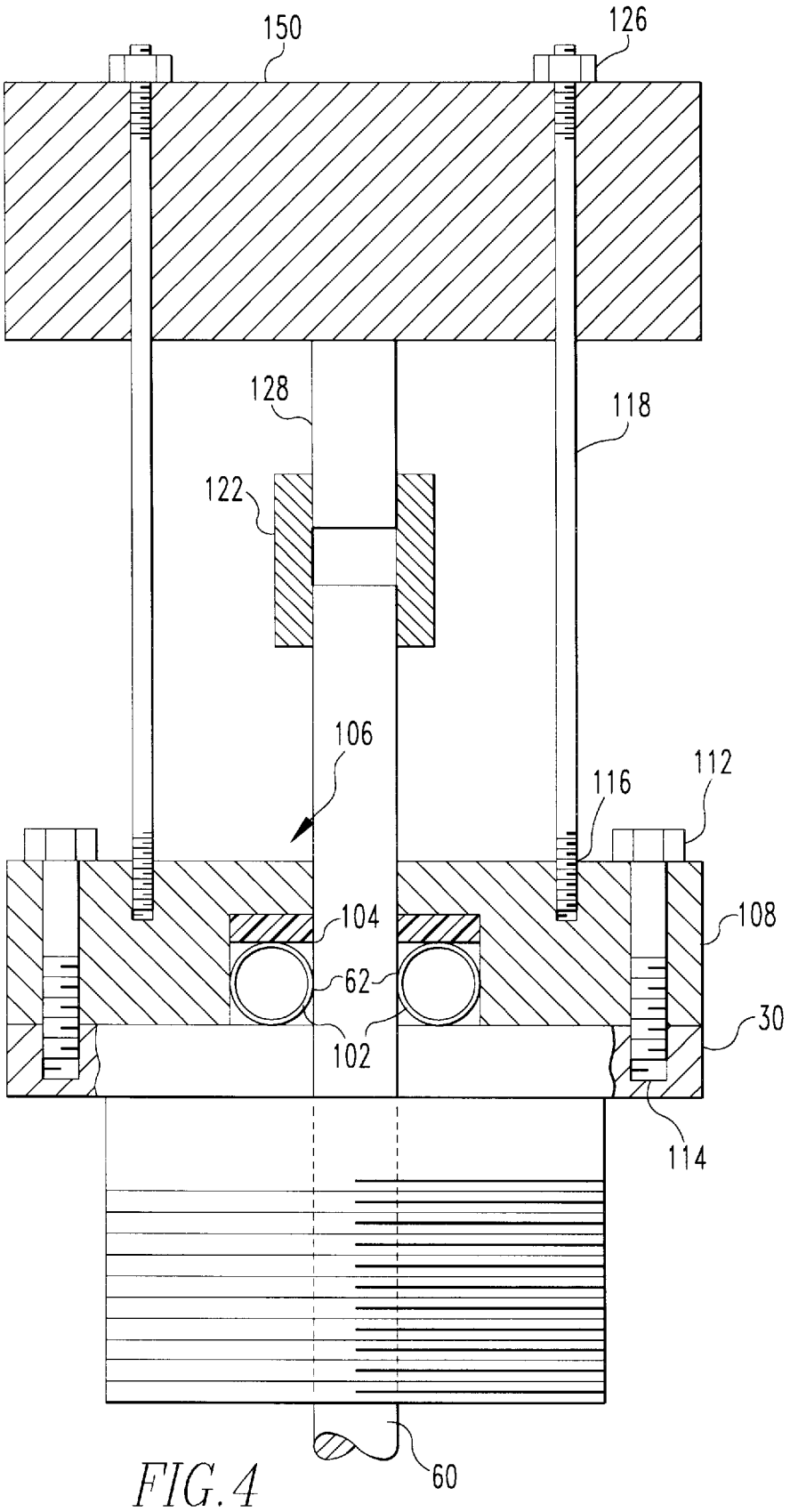
FIG. 4 is a schematic representation of a motor attached to the pressure vessel of the present invention.

The stirrer shaft 60 can be rotated by any mechanism such as a motor can be connected in a number of different ways, as shown in FIG. 4. In FIG. 4, the stirrer shaft 60 is connected to the motor shaft 128 through a motor coupler 122. The force exerted on the stirrer shaft is taken by a thrust washer 104 which rests on the surface 106 of the shaft coupler block 108. The shaft coupler block 108 is held on the cap 30 through the screws 112 that thread into screw holes 114 in the cap 30. The motor 150 is held to the cap through screws 126 attached into studs 118 which are screwed into the cap at 116.

Figure 5:
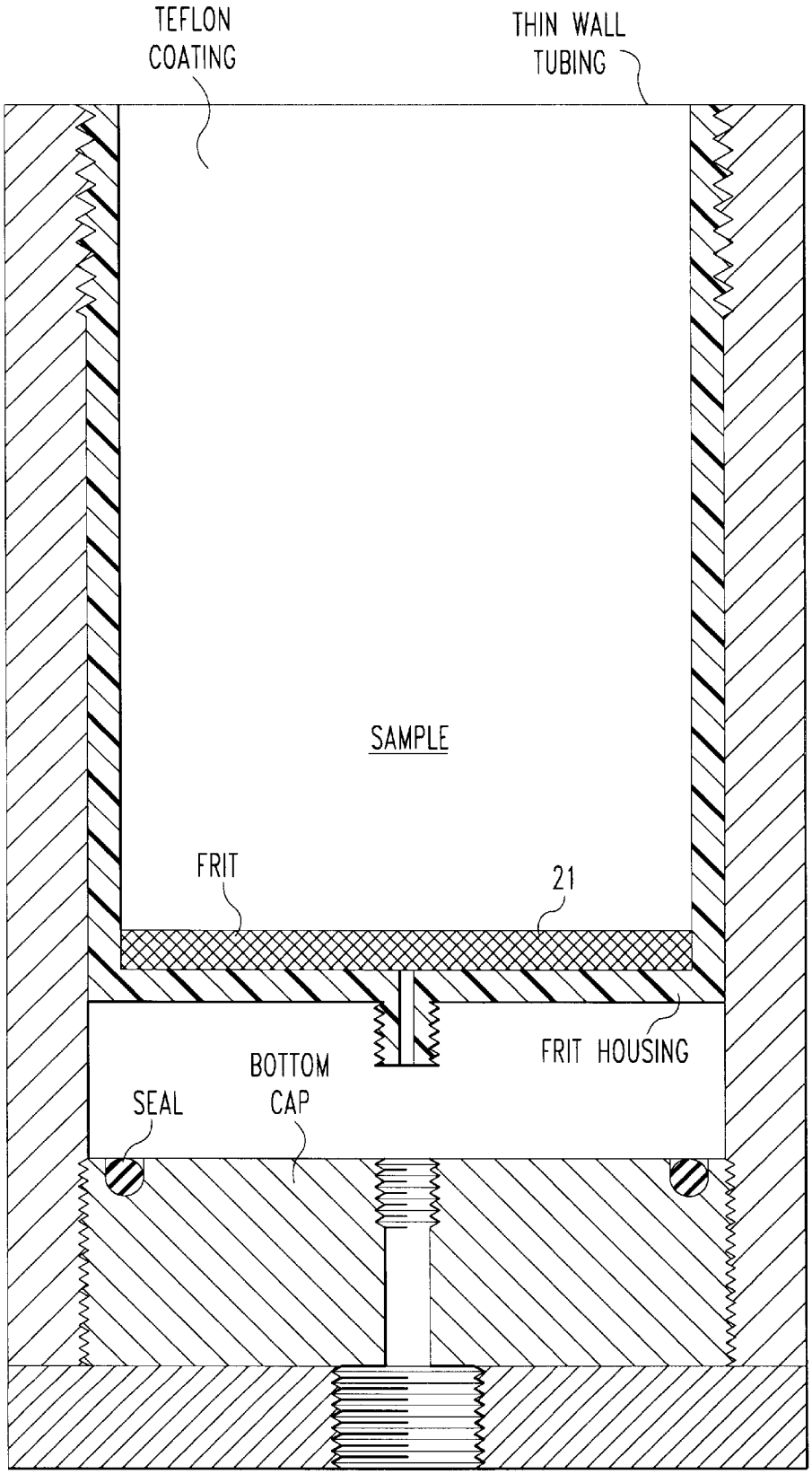
FIG. 5 is an alternative embodiment of the mixing apparatus.

The stirrer system is fairly simple to operate. The solid material is put into the high pressure vessel containing the stirrer system. All caps are closed and the fluid is introduced. The motor connecting to the stirrer system is switched on and the fluid begins to mix with the solid material. Higher temperatures may be needed to liquify the solid sample in some cases. The vessel is brought up to the correct pressure and left to mix for any length of time. Flow of the liquid is achieved by pumping in fluid and maintaining pressure while the reaction or extraction is carried out to the desired time. The operating conditions are maintained to the desired levels. At the end of experiment, the motor is switched off and the vessel is depressurized. Depending on the type of the experiment being conducted, the extracted or reacted material can be taken out. A special basket can be used to simplify the removal of the sample as shown in FIG. 5. One frit housing is pressed into one end of thin wall tubing. The thin wall tubing is coated with a thin layer of teflon to protect the seal surface from damage upon insertion of the basket. The basket is threaded into the bottom cap and the top cap with stirrer is screwed into the vessel to close the system. Depending on the amount of agitation and the nature of the sample being reacted, different stirring devices may be used as shown in FIGS. 6*a*, 6*b* and 6*c*.

Figure 6A:
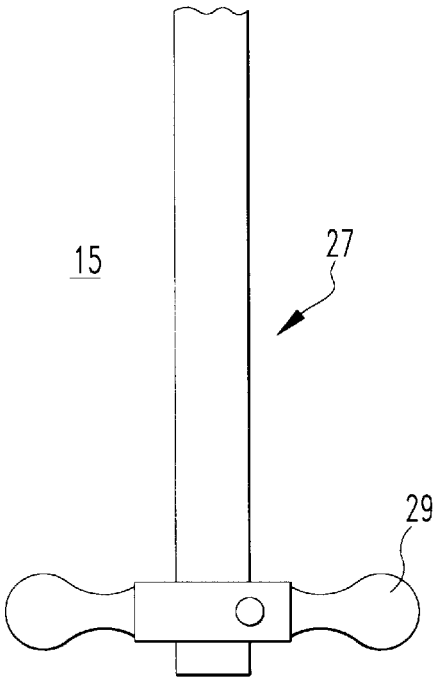
FIGS. 6*a*, 6*b* and 6*c* are schematic representations of stirrers of the present invention.
Figure 6B:
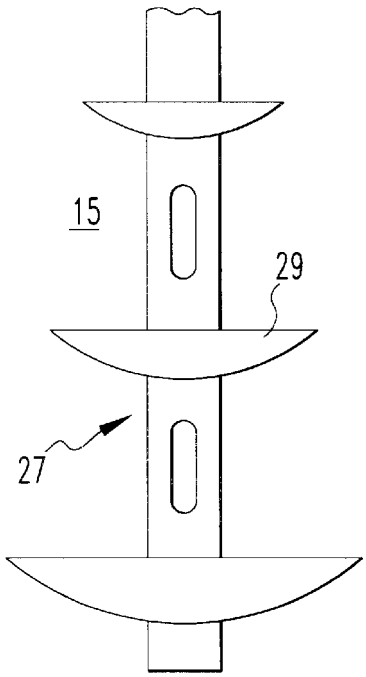
Figure 6C:
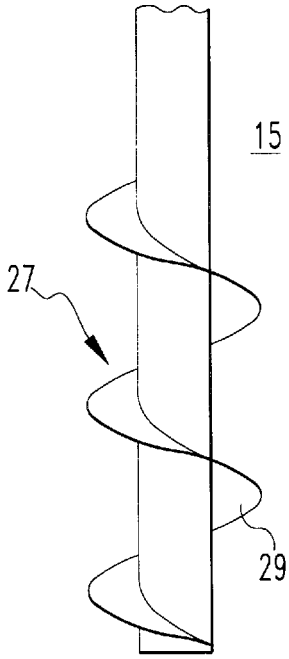

In regard to FIG. 6*a*, there is shown a stirrer with one layer of protrusion 29 extending from the shaft 60. In FIG. 6*b*, there is shown multiple layers of protrusions 29 extending from the shaft 60. In FIG. 6*c*, there is shown one continuous protrusion that winds about the shaft in a somewhat helical fashion.

EXAMPLE 1

| | |
|---|---|
| Vessel Size: | 25 ml |
| Vessel ID: | 10 mm |
| Seal: | Spring loaded graphite reinforced teflon |
| Shaft Material: | SS 304 |
| Shaft Surface: | Polished surface |
| RPM: | 50 rpm |
| Fluid: | Carbon Dioxide |
| Port: | One in the cap and one in the vessel |

EXAMPLE 2

| | |
|---|---|
| Vessel Size: | 500 ml |
| Vessel ID: | 2.125 inches |
| Seal: | Spring loaded graphite reinforced teflon |
| Shaft Material: | SS 304 |
| Shaft Surface: | Coated with ceramic |
| RPM: | 150 rpm |
| Fluid: | Carbon Dioxide |
| Port: | Both ports in the caps |

EXAMPLE 3

| | |
|---|---|
| Vessel Size: | 500 ml |
| Vessel ID: | 2.125 inches |
| Seal: | Spring loaded graphite reinforced teflon |
| Shaft Material: | SS 304 |
| Shaft Surface: | Coated with ceramic |
| RPM: | 150 rpm |
| Fluid: | Carbon Dioxide |
| Port: | Both ports in the caps |

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A mixing apparatus comprising:

a pressure vessel having a chamber and a first opening that communicates with the chamber;

a first cap which fits over the first opening to engage the vessel and close the first opening, said first cap having an inner seal groove and an outer seal groove;

a stirrer having a shaft, said shaft extending through the first cap at the inner seal groove into the chamber;

a motor connected to the shaft to turn the shaft, said motor disposed adjacent to the vessel and external to the chamber;

a first self-sealing seal means disposed between and in contact with the first cap and the vessel in the outer seal groove for sealing the first cap with the vessel as pressure increases in the vessel, said first self-sealing seal means having an inner lip and an outer lip, said inner lip contacting the cap, said outer lip contacting the vessel, said inner and outer lips being spread apart from each other and against the first cap and vessel, respectively, as pressure increases in the vessel, and a first spring disposed between the inner and outer lips to bias the lips against the cap and vessel, respectively; and a shaft self-sealing seal means for sealing the shaft to the first cap as pressure increases in the vessel, said shaft self-sealing seal means disposed between and in contact with the first cap and the shaft in the inner seal groove, said shaft rotatable in said shaft self-sealing seal means, said pressure providing force for the shaft self-sealing seal means to seal the shaft with the first cap, said shaft self-sealing seal means having an inner lip and an outer lip, said inner lip contacting the shaft, said outer lip contacting the first cap, said inner and outer lips being spread apart from each other and against the shaft and the first cap, respectively, as pressure increases in the vessel, and a second spring disposed between the inner and outer lips of the shaft self-sealing seal means to bias the lips against the shaft and the vessel, respectively.

2. An apparatus as described in claim 1 wherein the first cap has a first port through which material is introduced into the chamber.

3. An apparatus as described in claim 2 wherein the vessel has a second opening in communication with the chamber and including a second cap which fits over the second opening to engage the vessel and close the second opening, and a second self-sealing seal disposed between and in contact with the second cap and the vessel to seal the second cap with the vessel as pressure increases in the vessel.

4. An apparatus as described in claim 3 wherein the second cap has a second port through which material is introduced into the chamber.

5. An apparatus as described in claim 4 wherein the vessel is threaded about the first and second openings, and the first and second caps are threaded to threadingly engage with the vessel at the respective first and second openings.

6. An apparatus as described in claim 5 including a seal retainer disposed about the shaft which holds said shaft self-sealing seal means in place.

7. An apparatus as described in claim 6 including an insert disposed in the first cap through which the shaft extends, said insert maintaining and aligning the shaft in the chamber.

8. An apparatus as described in claim 7 wherein the shaft has a first portion disposed in the chamber, and including protrusions extending from the first portion of the shaft.

9. An apparatus as described in claim 8 wherein the shaft is made out of sapphire.

10. A mixing apparatus comprising:

a pressure vessel having a chamber and a first opening that communicates with the chamber, said vessel has a second opening in communication with the chamber;

a first cap which fits over the first opening to engage the vessel and close the first opening, said first cap has a first port through which material is introduced into the chamber;

a stirrer having a shaft, said shaft extending through the first cap into the chamber;

a motor connected to the shaft to turn the shaft, said motor disposed adjacent to the vessel and external to the chamber;

a first self-sealing seal disposed between and in contact with the first cap and the vessel to seal the first cap with the vessel as pressure increases in the vessel;

a shaft self-sealing seal which seals the shaft to the first cap as pressure increases in the vessel, said shaft self-sealing seal disposed between and in contact with the first cap and the shaft, said shaft rotatable in said shaft self-sealing seal; and a second cap which fits over the second opening to engage the vessel and close the second opening, and a second self-sealing seal disposed between and in contact with the second cap and the vessel to seal the second cap with the vessel as pressure increases in the vessel, said second cap having a second port through which material is introduced into the chamber, said vessel is threaded about the first and second openings, and the first and second caps are threaded to threadingly engage with the vessel at the respective first and second openings.

* * * * *